US006722919B2

(12) United States Patent
Lin

(10) Patent No.: US 6,722,919 B2
(45) Date of Patent: Apr. 20, 2004

(54) ELECTRICAL CONNECTOR FIXTURE AND ELECTRICAL CONNECTOR USING SAME

(75) Inventor: Tung-Chang Lin, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/358,298

(22) Filed: Feb. 4, 2003

(65) Prior Publication Data

US 2003/0171031 A1 Sep. 11, 2003

(30) Foreign Application Priority Data

Feb. 8, 2002 (TW) ..... 91201744 U

(51) Int. Cl.[7] ..... H01R 13/60
(52) U.S. Cl. ..... 439/569; 439/79; 439/607
(58) Field of Search ..... 439/79, 569, 83, 439/607

(56) References Cited

U.S. PATENT DOCUMENTS 5,316,488 A * 5/1994 Gardner et al. ..... 439/79
5,322,447 A * 6/1994 Okada ..... 439/79
5,897,384 A * 4/1999 Hosler, Sr. ..... 439/63
5,993,258 A * 11/1999 Matsunuma et al. ..... 439/607
6,558,191 B2 * 5/2003 Bright et al. ..... 439/541.5

* cited by examiner

*Primary Examiner*—Tho D. Ta
(74) *Attorney, Agent, or Firm*—Robert J. Zeitler

(57) ABSTRACT

The present invention discloses a connector fixture, comprising a connector and a holding member; wherein the holding member forms a space for accommodating the connector, and the holding member on each of its left and right sides has one or more fixing surfaces extended upward, such that the end of the signal terminal of the connector is also bent upward to keep the connector in a positive plug-in direction when the connector is installed at the bottom of the circuit board.

20 Claims, 8 Drawing Sheets

PRIOR ART

ELECTRICAL CONNECTOR FIXTURE AND ELECTRICAL CONNECTOR USING SAME

FIELD OF THE INVENTION

The present invention relates to a connector fixture, more particularly to a connector fixture that can keep the connector to be plugged in a positive direction for transmitting signals when the connector is installed at the bottom of the circuit board.

BACKGROUND OF THE INVENTION

In general, a connector is used to connect two disconnected cables, or connect two disconnected circuits for electrical connection. Such connector is a well known art, and the universal series bus (USB) connector is one of the examples commonly used in computer hardware. However, as the information technology is blooming day after day, many portable electronic products such as personal digital assistant (PDA) or mobile phone become more popular and thus bring in various expansions of connectors for offering convenience and efficiency to the present electronic products.

In FIG. 1, the prior-art connector 1*a* comprises an insulator 10*a*, and a shield housing 11*a* surrounding the insulator 10*a*; wherein the shield housing 11*a* is formed by bending a thin metal plate; a plurality of fixing surfaces 12*a* protruded vertically downward and disposed on the right and left sides of the shield housing 11*a*, and the fixing surfaces 12*a* can be used to fix the connector 1*a* on a circuit board 2*a* by the surface mount technology (SMT) or insert (not shown in the figure) for receiving the insertion of a plug (not shown in the figure) and proceeding with signal transmission.

However, since there are various electronic products not just for improving their functions, but also focusing on the exterior look to meet consumer's requirement, therefore many manufacturers invest a great deal of money on research and development to design various electronic products with powerful functions and beautiful appearance to attract customers for the purchase. While manufacturers are designing and developing these products, some of them set the connector 1*a* at the bottom of the circuit board 2*a* (as shown in FIG. 2) to match the appearance of the product. However, the plug (not shown in the figure) originally plugged into a connector 1*a* in a positive direction has to be turned 180 degrees before it can be plugged into the connector 1*a*. Unlike regular connections, such reverse connection will affect user's application and cause inconvenience to the user. Even worse, it may cause a wrong connection and result in damages to the connector 1*a*.

It is known from the above that the prior-art connector is needed for various designs to match the appearance of electronic products by installing the connector at the bottom of the circuit board. Such arrangement is obviously inconvenient in its practical application and needs to be improved.

Therefore, in view of these shortcomings, the inventor of the present invention based on years of experience accumulated from the engagement in the related industry conducted extensive research to resolve the aforementioned shortcomings and invented the present invention.

SUMMARY OF THE INVENTION

The primary objective of the present invention is to provide a connector fixture to overcome the shortcomings due to the installation of the connector at the bottom of the circuit board, and to avoid the appearance of electronic products from being affected by the position of the connector with respect to the circuit board.

To accomplish the foregoing objective, the present invention provides a connector fixture having a connector and a holding member; wherein the holding member forms a space to accommodate the connector, and the holding member on each of its left and right sides has one or more fixing surfaces extended upward, so that the end of the signal terminal of the connector is also bent upward to keep the connector to be plugged in the positive direction when the connector is installed at the bottom of the circuit board. Such arrangement can avoid the exterior design of electronic products from being affected by the position of the connector and thus accomplish the above objective.

To make it easier for our examiner to understand the objective of the invention, its structure, innovative features, and performance, we use the disclosed embodiments together with the attached drawings for the detailed description of the novel features of the present invention.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE DISCLOSED EMBODIMENTS

Figure 1:
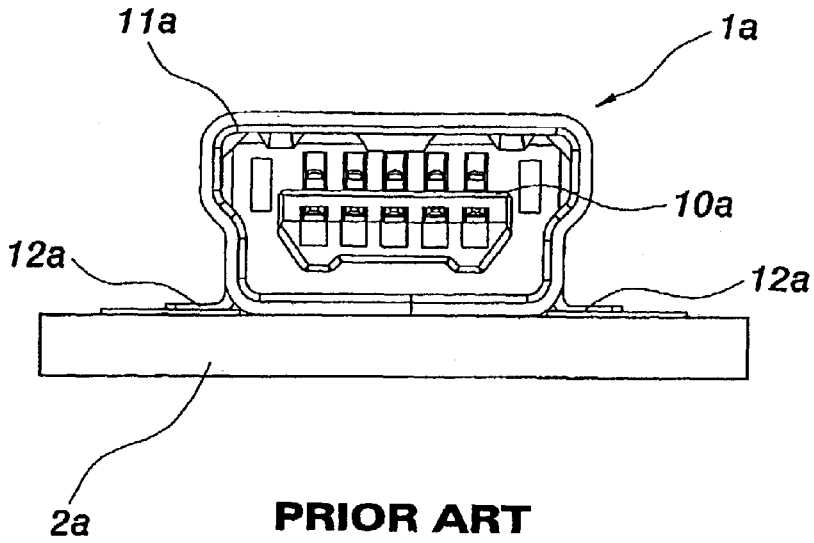
FIG. 1 is a front-view diagram of a prior-art connector on a circuit board.
Figure 2:
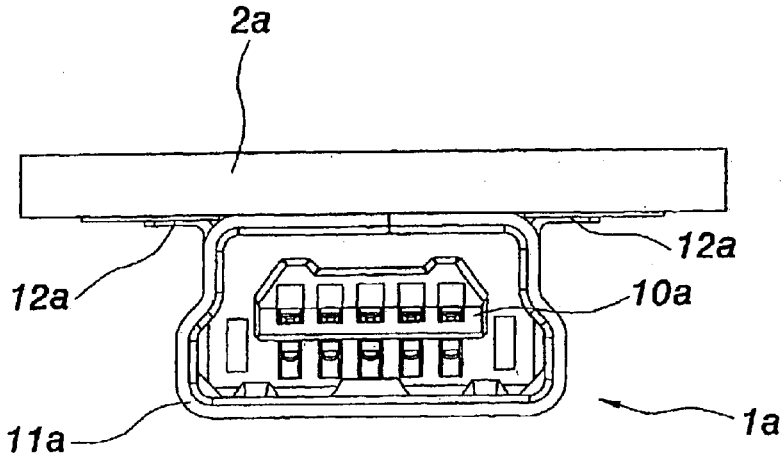
PRIOR ART FIG. 2
FIG. 2 is a front-view diagram of a prior-art connector at the bottom of a circuit board.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 3:
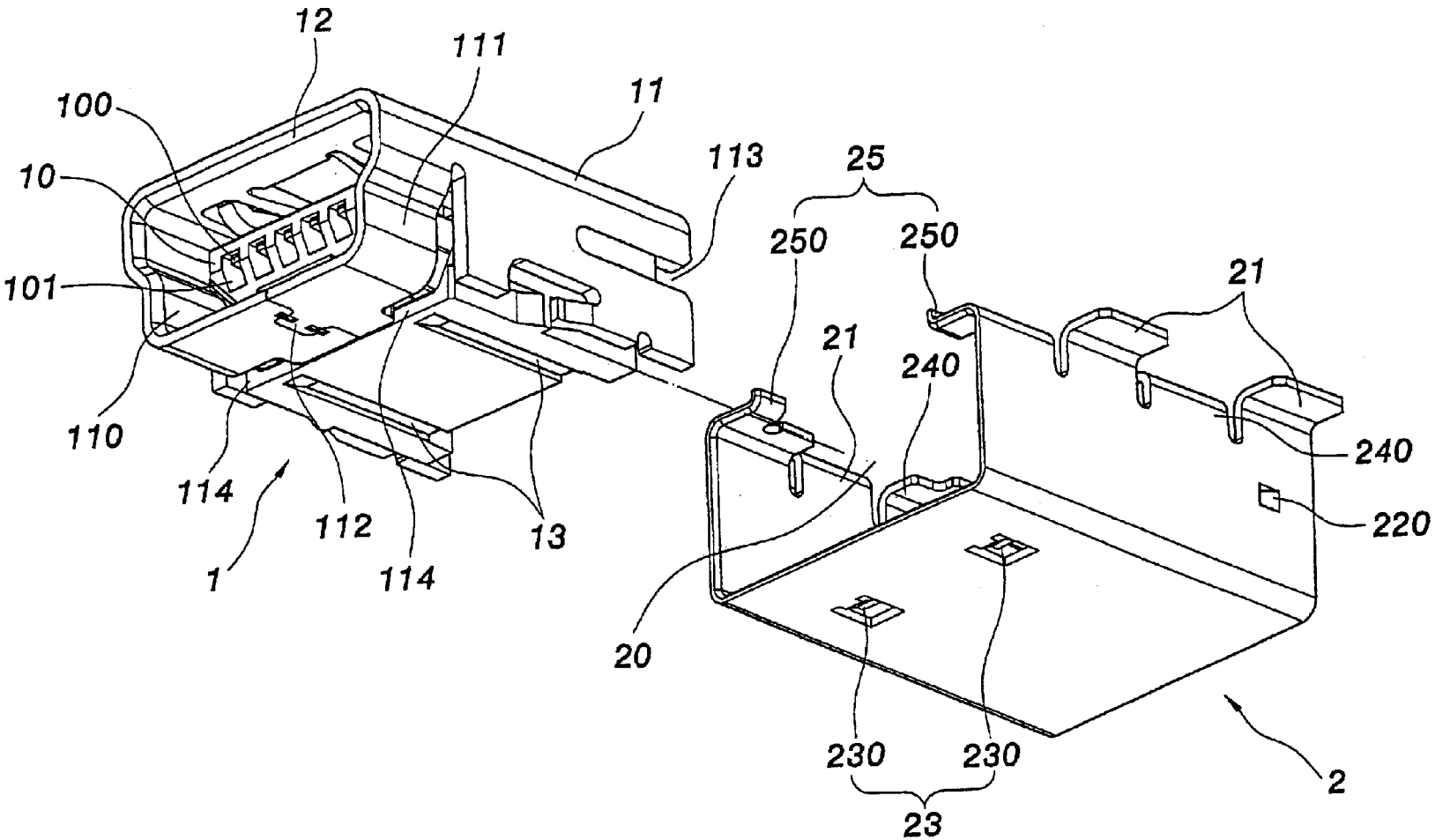
FIG. 3 is a perspective diagram of the disassembled parts of the first preferred embodiment of the present invention.
Figure 4:
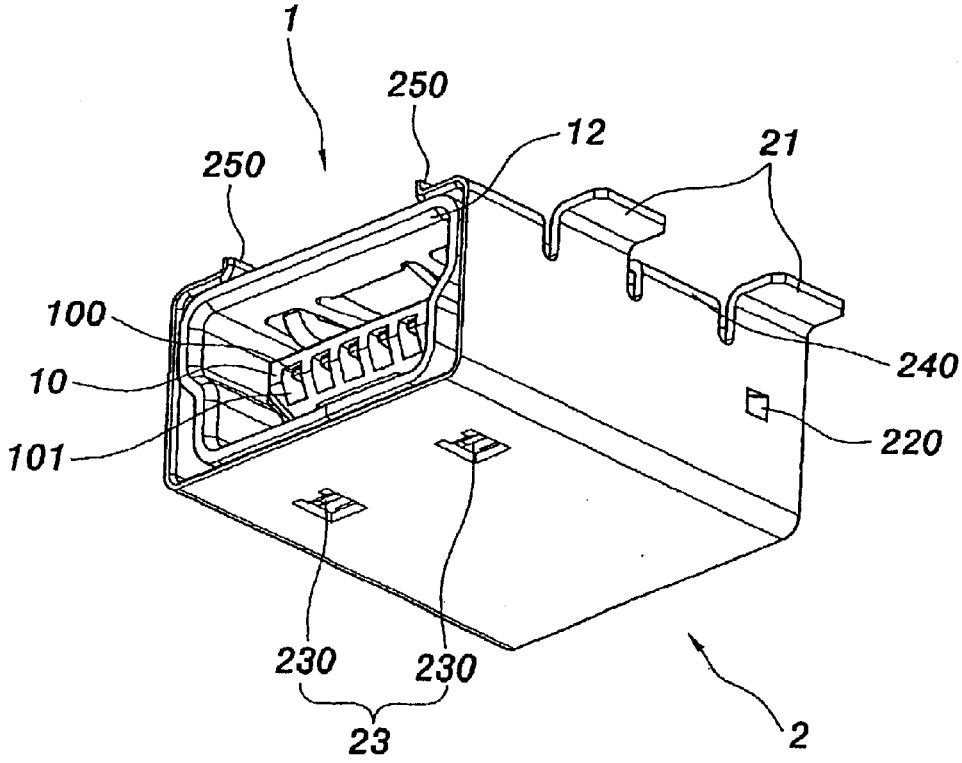
FIG. 4 is a perspective diagram of the assembled parts of the first preferred embodiment of the present invention.
Figure 5:
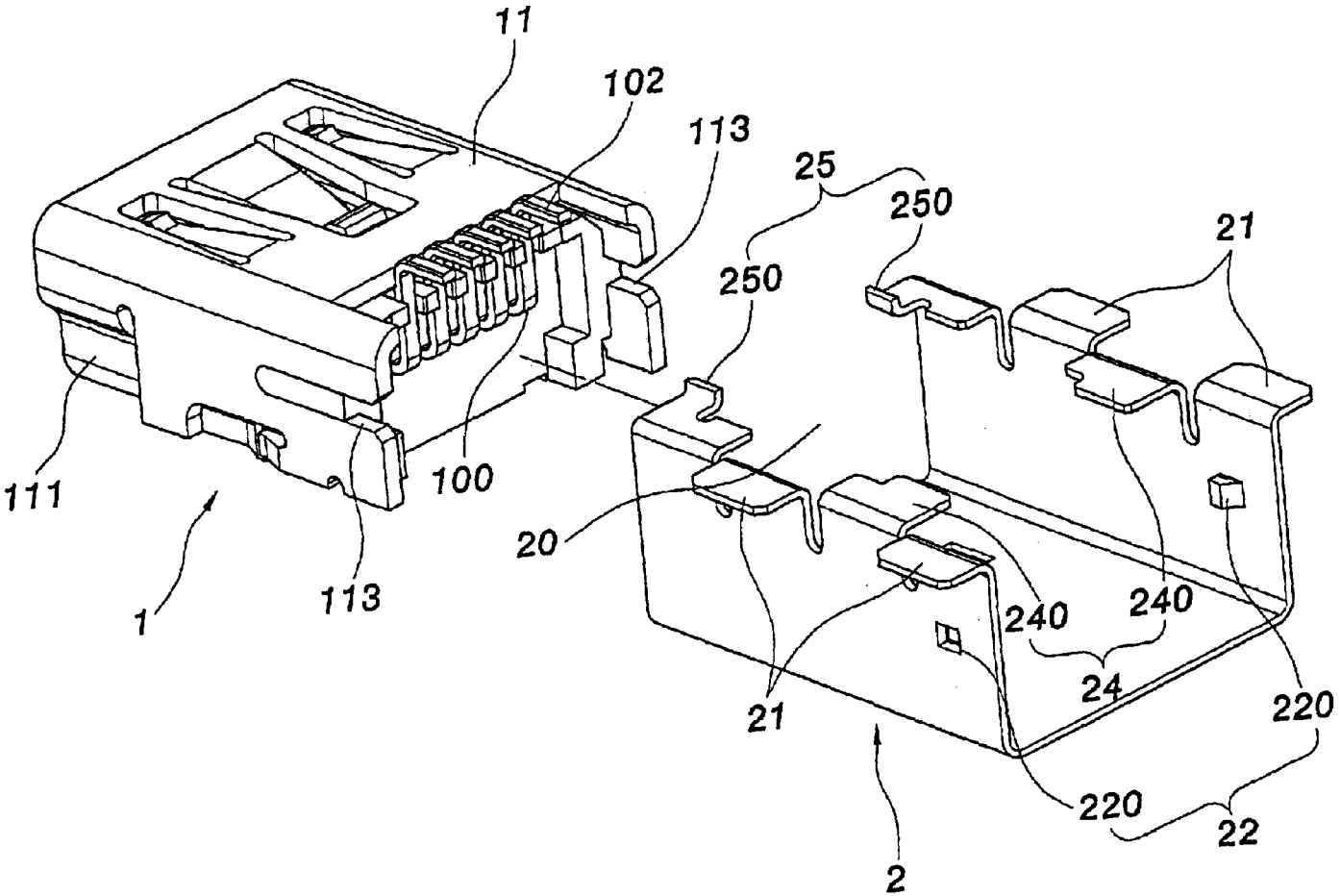
FIG. 5 is another perspective diagram of the assembled parts of the first preferred embodiment of the present invention.

Referring to FIGS. 3, 4, and 5 for the perspective diagrams of the disassembled parts, the assembled parts viewing from another angle, and the assembled parts of the first preferred embodiment of the present invention respectively. The connector fixture of the present invention provides a structure that can keep the plug to be plugged in a positive direction when the connector is installed at the bottom of the circuit board. The connector fixture of the present invention comprises a connector 1 and a holding member 2 for accommodating the connector 1; wherein the connector 1 is the same as the prior art, basically including an insulator 10 and a shield housing 11 surrounding the insulator 10, and a plurality of terminal slots penetrating through the insulator for connecting a plurality of signal terminals 100, and extending the end of the signal terminals 100 from the rear surface of the connector 1 (as shown in FIG. 5). However, unlike the prior art, the present invention has the signal terminal 100 bent into an inverse direction such that its end is bent upward and individually forms a contact end 102 for electrically connected to a circuit board 3 (not shown in the figure).

The shield housing 11 of the connector 1 is also made by bending a metal plate to surround the insulator 10, so that the shield housing 11 individually extends a halved plate 110, 111 downward from the corresponding positions at the front end of the left and right sides of the shield housing 11. The two halved plates are bent and coupled by a dovetail groove 112 to form a socket for being plugged by the connector 1 and a plug (not shown in the figure).

Figure 6:
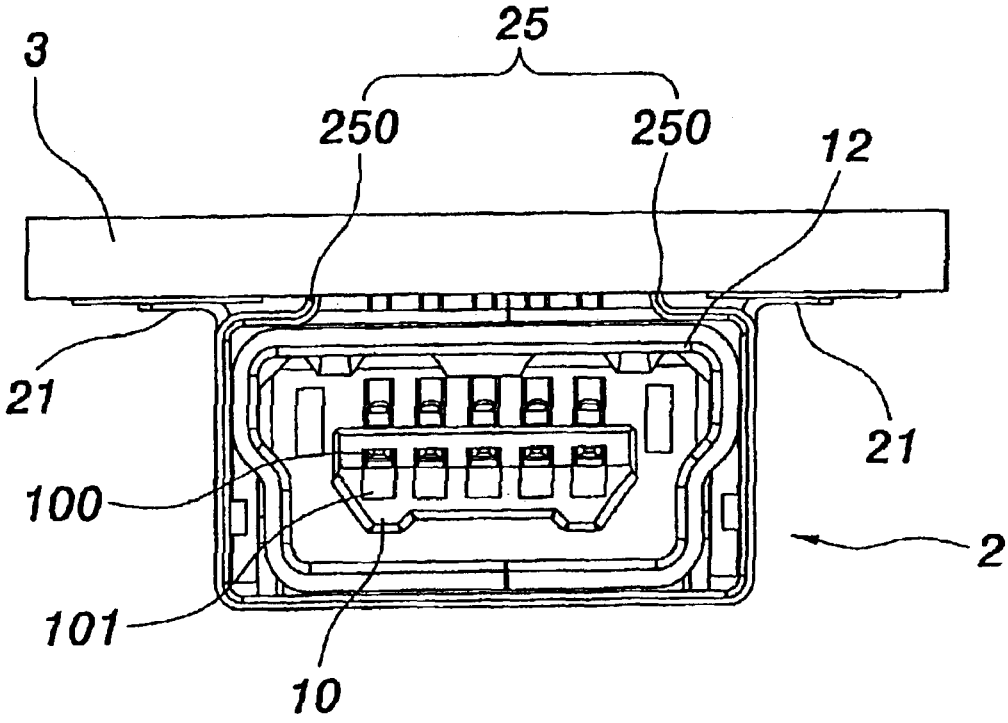
FIG. 6 is a front-view diagram of a connector at the bottom of a circuit board according to the first embodiment of the present invention.

The holding member is made by bending a metal plate according to the shape of the connector 1, so that the surfaces of the front and rear ends constitute a "U" shape structure and a space for accommodating the connector 1. In the meantime, at least one fixing surface 21 is disposed individually at the upper edge on both the left and right sides of the holding member 2, and the fixing surfaces 21 can be individually bent outward and vertically upward on the left and right sides of the holding member 2 as shown in the first preferred embodiment (see FIGS. 3 to 6) to fix the connector 1 onto a circuit board 3 by the surface mount technology (SMT) as shown in FIG. 6, or as the second preferred embodiment (see FIGS. 7 and 8) separately extends the fixing surfaces 21 vertically upward on the left and right sides of the holding member 2 and the connector 1 is secured by the plug-in method (not shown in the figure) instead. Therefore, the plug (not shown in the figure) of the connector 1 remains in the positive plug-in direction by means of the accommodation provided by the holding member 2 when the connector is installed at the bottom of the circuit board, and thus the exterior design of the electronic product will not be affected by the installation position of the connector. The foregoing structure constitutes the connector fixture of the present invention.

Figure 7:
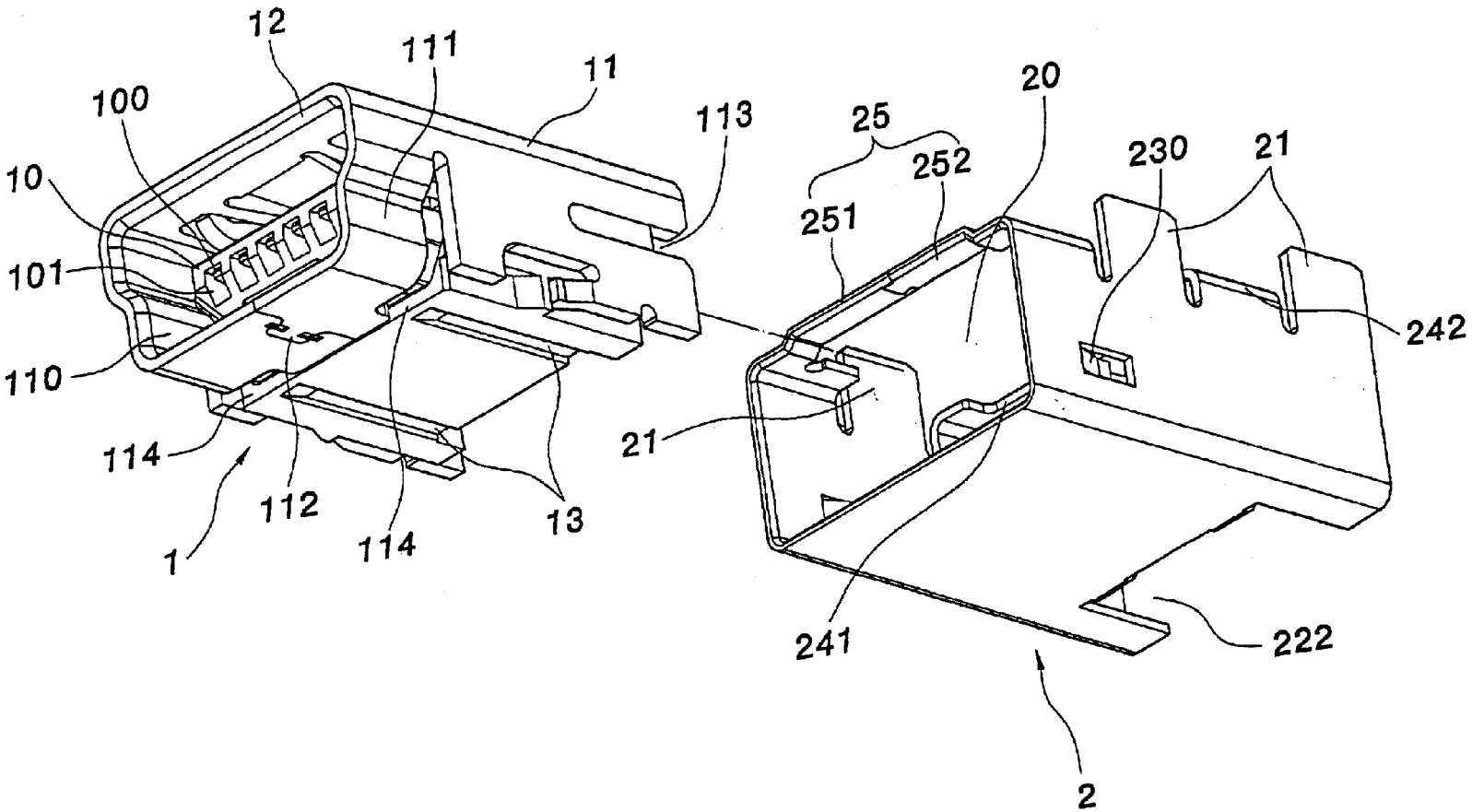
FIG. 7 is a perspective diagram of the disassembled parts of the second preferred embodiment of the present invention.
Figure 8:
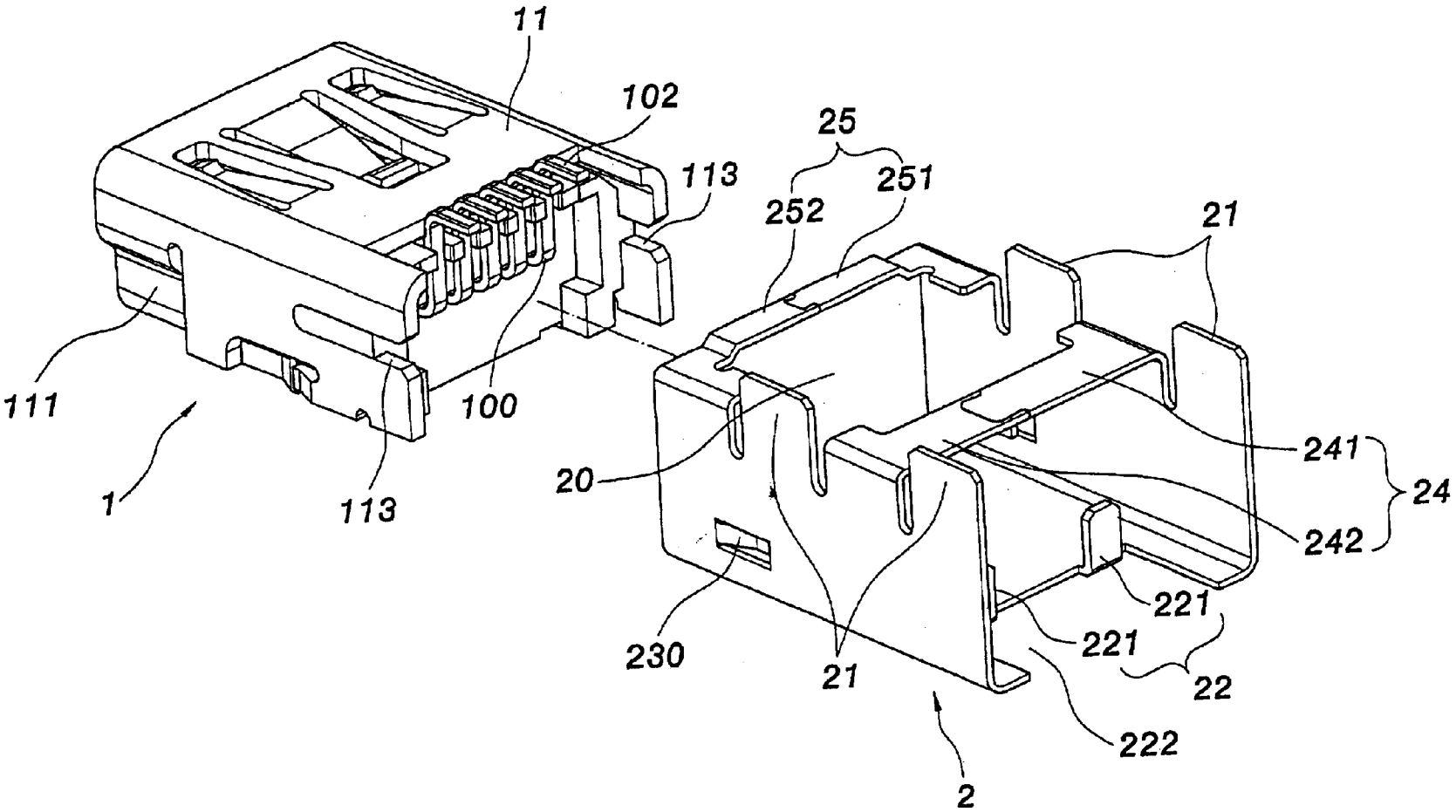
FIG. 8 is another perspective diagram of the disassembled parts of the second preferred embodiment of the present invention.

Refer to FIGS. 3, 5, 7, and 8. These figures show how to secure the connector 1 into the holding member 2 with a better way after they are assembled. The present invention further comprises a blocking section 22 and a latching section 23 in the holding member 2 for blocking and latching the connector 1, and a compressing section 24 in the holding member 2 to tightly clip the connector 1; wherein the blocking section 22 blocks the rear side of the connector 1 when the connector 1 is plugged in the front end of the holding member 2 to avoid the connector 1 to be squeezed out from the rear end of the holding member 2. In the first preferred embodiment of the present invention (as shown in FIGS. 3 and 5), the blocking section 22 comprises two blocking members 220 individually protruded from the inner left and right sides of the holding member 2, while the connector 1 together with the holding member 2 have a concave groove 113 at the rear edge of the left and right sides of the shield housing 11 corresponding to the two blocking members 220, so that the two blocking members 220 are embedded individually into the two concave grooves 113, and will not be squeezed out from the rear end of the holding member 2. Further, in the second preferred embodiment of the present invention (as shown in FIGS. 7 and 8), the blocking section comprises at least one blocking plate 221 disposed at the rear edge of the lower end of the holding member 2, or has an opening 222 at the rear end of the holding member before allowing the blocking plate 221 to be formed on such opening 222. Therefore, after the connector 1 is inserted into the holding member, the blocking plate 221 will be bent upward to press against the rear surface of the connector 1 in order to accomplish the same effect as above.

The latching section 23 restricts the connector 1 from being withdrawn out of the holding member 2 by the reaction force after the connector is inserted into the space 20. In the first embodiment of the present invention (as shown in FIGS. 3 and 5), the latching section 23 comprises 2 brackets 230 bent towards the space 20 and disposed at the lower end of the holding member 2. Since the two halved members 110, 111 of the connector 1 are bent to form a groove 114, each on the shield housing 11, and these two grooves 114 are extended separately from the lower end of the shield housing 11 to the left and right sides of the shield housing 11, therefore after the two brackets 230 at the ends of the holding member 2 are inserted into the space 20, the two brackets 230 are latched into the groove 114 at the lower section of the holding member 2, so that the connector 1 is unable to withdraw out from the holding member 2. Two parallel longitudinal guiding grooves 13 can be set on the lower end of the connector 1, so that the two guiding grooves correspond with the two brackets 230 and guide the connector 1 into the holding member 2. Furthermore, in the second embodiment of the present invention (FIGS. 7 and 8), the latching section 23 also comprises two brackets 230 bent towards the space 20, but the two brackets 230 this time are disposed on the left and right side of the holding member 2 to separately latch the left and right sides of the connector 1 into the groove 114.

The compressing section 24 presses against the connector 1 and the holding member 2 to couple the two into one. In the first embodiment of the present invention (FIGS. 3 and 5), the compressing section 24 comprises two clipping plates 240, each disposed on the left and right sides of the holding member 2, and the connector 1 is inserted into the holding member 2, and the two clipping plates 240 are bent vertically inward from the left and right sides of the holding member 2, so that the bent clipping plates 240 presses against the upper end of the connector 1. Further, in the second embodiment of the present invention (FIGS. 7 and 8), the compressing section 24 comprises two wrapping plates 241, 242 being bent inward and coupled with each other, and the two wrapping plates 241, 242 are disposed individually at the upper edge of the left and right sides of the holding member 2.

Figure 9:
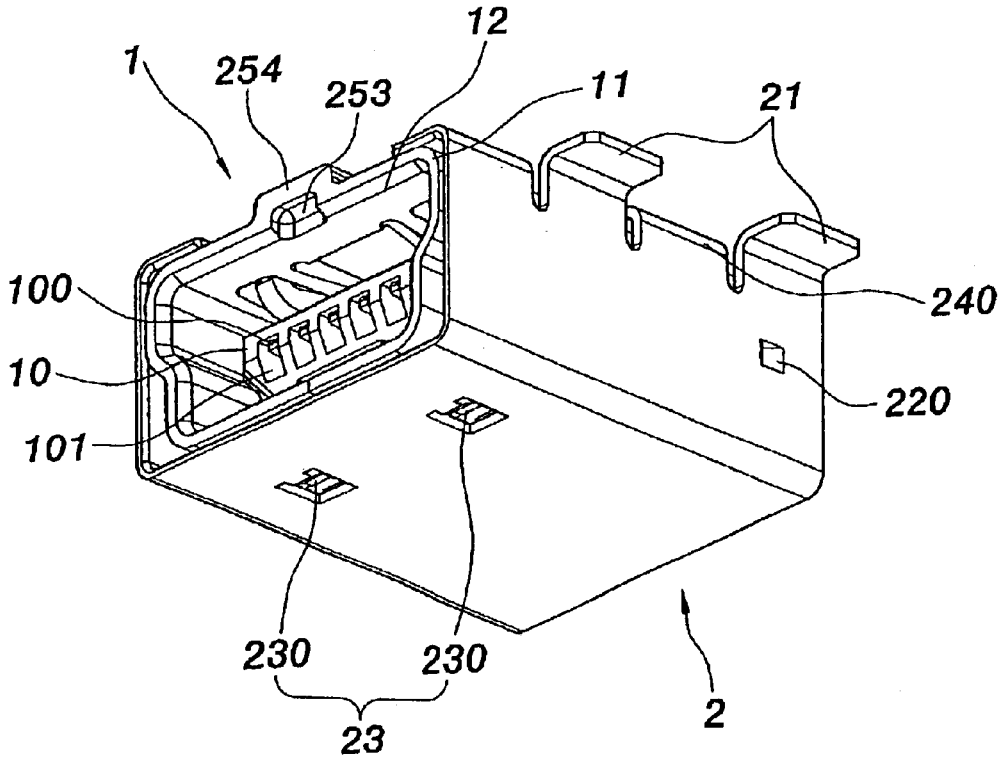
FIG. 9 is a perspective diagram of the assembled structure of the second preferred embodiment of the present invention.

In FIG. 6, the present invention comprises a supporting section 25 on the socket 12 of the connector, serving as a supporting base between the socket 12 of the connector 1 and the circuit board 3, so that the socket 12 can bear the user's plugging and unplugging movement of the connector without loosening the connector. In the first preferred embodiment of the present invention (as shown in FIGS. 3 and 5), a supporting surface 250 is formed by bending the left and right sides of the front end of the holding member 2 to press against the bottom surface of the circuit board (as shown in FIG. 6). Further, in the second preferred embodiment of the present invention (as shown in FIGS. 7 and 8), the supporting section 25 comprises two supporting plates 251, 252 coupled to each other, and extending outward from the left and right sides of the front end of the holding member 2. The two coupled supporting plates 251, 252 form a high level platform upward. Furthermore, in the third preferred embodiment of the present invention (as shown in FIG. 9), the supporting section 25 comprises a concave opening 253 which is punched from the middle section of the inner edge at the upper end of the socket 12 of the connector 1, so that a "n" shaped member 254 is disposed at the upper end of the shield housing 11 of the connector 1, and is in contact with the circuit board 3. Furthermore, the connector fixture of the present invention can keep the plug (not shown in the figure) in a positive plug-in direction when the connector 1 is installed at the bottom of the circuit board. Therefore, the exterior design of the electronic product will not be affected by the connector that is installed at the bottom of the circuit board. In addition, since the holding member 2 is disposed outside the connector 1, therefore it enhances the prevention of electromagnetic interference.

While the invention has been described by way of example and in terms of the disclosed embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A connector fixture, comprising:

a connector, the connector including an insulating housing, the insulating housing including a plurality of terminals for making electrical contact with a circuit board; and a holding member, the holding member forming a space for accommodating the connector, and the holding member on each of its left and right sides having at least one fixing surface extended upward so that when the connector is placed within the holding member the orientation of the connector is the same when the connector is installed on a bottom of the circuit board as when the connector is installed on a top surface of the circuit board without the use of the holding member.

2. The connector fixture of claim 1, wherein said fixing surfaces are disposed separately on the left and right sides of the holding member and extend upward.

3. The connector fixture of claim 1, further comprising a blocking section and a latching section in the holding member for blocking and latching the connector within the holding member.

4. The connector fixture of claim 3, including a compressing section in the holding member for tightly holding the connector.

5. The connector fixture of claim 3, wherein said blocking section comprises a blocking member, each protruded from the inner side of the left and right sides of the holding member; and a groove is disposed at the rear edge of the left and right sides of the connector corresponding to the two blocking members for receiving the blocking member.

6. The connector fixture of claim 3, wherein said latching section comprises two brackets bent towards the space in the holding member and disposed separately on the left and right sides of the holding member, forming a groove on the left and right sides of the connector for individually latching the two brackets.

7. The connector fixture of claim 3, wherein said compressing section comprises two clipping plates disposed at the upper edge of the left and right sides of the holding member, and individually bent vertically inward from the left and right sides of the holding member to press the upper end of the connector.

8. The connector fixture of claim 3, wherein said compression section comprises two wrapping plates, individually disposed at the upper edge of the left and right sides of the holding member, and the two wrapping plates are bent inward and coupled with each other to press against the upper end of the connector.

9. The connector fixture of claim 3, wherein said blocking section comprises at least one blocking plate disposed at the rear edge of the lower end of the holding member, such that the blocking plate is bent upward to press against the rear surface of the connector.

10. The connector fixture of claim 9, wherein said holding member at its lower end has an opening being formed on the blocking plate.

11. The connector fixture of claim 3, wherein said latching section comprises two brackets disposed at the lower end of the holding member and bent towards the space in the holding member to form a groove on the connector for latching the two brackets.

12. The connector fixture of claim 11, wherein said connector at its external side of the lower end has two parallel guiding grooves corresponding to the two brackets for guiding the connector to couple with the holding member.

13. The connector fixture of claim 1, wherein the connector has a socket and wherein the holding member has a support section disposed above the socket of the connector.

14. The connector fixture of claim 1, wherein said support section forms a support surface by individually bending the front end of the left and right sides of the holding member upward.

15. The connector fixture of claim 13, wherein said support section comprises two supporting plates being coupled with each other, and individually extending outward from the left and right sides at the front end of the holding member so that the two supporting plates constitute a high level platform.

16. The connector fixture of claim 13, wherein said support section has a concave opening disposed at the middle part of the inner edge on the upper end of the socket of the connector to form a protruded "n" shaped member.

17. A connector fixture, comprising:

a connector, for receiving a plug being plugged into the connector at the bottom of a circuit board in a positive direction, and the end of the signal terminal of the connector being bent upward and electrically coupled with the circuit board, the connector including an shield about a housing of the connector; and a holding member, separate from the shield about the housing of the connector, forming a space for accommodating the connector, and the holding member on each of its left and right sides having at least one fixing surface coupled to the circuit board.

18. The connector fixture of claim 17, wherein said fixing surfaces are disposed separately on the left and right sides of the holding member and extended upward to be coupled onto the circuit board.

19. The connector fixture of claim 17, further comprising a blocking section and a latching section in the holding member for blocking and latching the connector within the holding member.

20. The connector fixture of claim 19, wherein said blocking section comprises at least one blocking plate disposed at the rear edge of the lower end of the holding member, such that the blocking plate is bent upward to press against the rear surface of the connector.

* * * * *